US010894201B2

(12) United States Patent
Botha et al.

(10) Patent No.: US 10,894,201 B2
(45) Date of Patent: Jan. 19, 2021

(54) PLAYING-CARD CASE

(71) Applicant: 10X BETA, LLC, Brooklyn, NY (US)

(72) Inventors: Marcel Botha, Brooklyn, NY (US); Elliott Felix, Brooklyn, NY (US)

(73) Assignee: 10X BETA, LLC, Brooklyn, NY (US)

( * ) Notice: Subject to any disclaimer, the term of this patent is extended or adjusted under 35 U.S.C. 154(b) by 0 days.

(21) Appl. No.: 16/461,445

(22) PCT Filed: Nov. 16, 2017

(86) PCT No.: PCT/US2017/062015

§ 371 (c)(1),
(2) Date: May 16, 2019

(87) PCT Pub. No.: WO2018/094047

PCT Pub. Date: May 24, 2018

(65) Prior Publication Data

US 2019/0344156 A1 Nov. 14, 2019

Related U.S. Application Data

(60) Provisional application No. 62/422,865, filed on Nov. 16, 2016.

(51) Int. Cl.
*A63F 1/06* (2006.01)
*A63F 1/14* (2006.01)

(52) U.S. Cl.
CPC ..... *A63F 1/062* (2013.01); *A63F 1/14* (2013.01)

(58) Field of Classification Search
USPC ..... 473/379; 273/379
See application file for complete search history.

(56) References Cited

U.S. PATENT DOCUMENTS 1,555,054 A * 9/1925 Berkowitz ..... B65D 5/3607 229/108.1
2,315,136 A * 3/1943 Platkin ..... A63F 1/06 206/526

(Continued)

OTHER PUBLICATIONS

International Search Report and Written Opinion Form PCT/ISA/220 and PCT/ISA/237, International Application No. PCT/US2017/062015, pp. 1-21, International Filing Date Nov. 16, 2017, dated Mar. 9, 2018.

(Continued)

*Primary Examiner* — John E Simms, Jr.
*Assistant Examiner* — Dolores R Collins
(74) *Attorney, Agent, or Firm* — Bond Schoeneck & King, PLLC; George McGuire

(57) ABSTRACT

The present invention is a foldable playing-card case suitable for dealing cards. The case includes three portions, each having a base and a pair of opposing sidewalls extending perpendicular from each base. The base of the first portion has a slit sized to deal cards therethrough. The second portion has an angled wall connected to the base. The angled wall of the second portion is hingedly connected to the base of the first portion. The base of the third portion is hingedly connected to the base of the second portion and the base of the third portion is also connected to an angled wall. The case has two pairs of magnets, a pair of magnets on the opposing sidewalls of the first portion and the third portion. The pairs of magnets connect when the base of the first portion is rotated toward the angled wall of the third portion.

20 Claims, 13 Drawing Sheets

(56) References Cited

U.S. PATENT DOCUMENTS 2,373,977 A * 4/1945 Scherer ..... B65D 5/248 229/145
3,166,235 A * 1/1965 Schroeder ..... B65D 5/067 229/120
3,219,181 A * 11/1965 Dahm ..... B65D 5/542 206/45.21
3,273,779 A * 9/1966 Mykleby ..... B65D 81/1075 206/523
3,318,354 A * 5/1967 Borisof ..... A45C 11/323 206/38.1
3,543,995 A * 12/1970 Wilson ..... B65D 5/6664 229/102
3,814,436 A * 6/1974 Boren ..... A63F 1/14 273/296
4,791,883 A * 12/1988 Lehman ..... A01K 1/0125 119/168
4,860,948 A * 8/1989 Hofstede ..... B65D 5/3642 229/143
4,940,239 A * 7/1990 Tuttle ..... A63F 3/04 273/243
4,948,139 A * 8/1990 Heeszel ..... A45C 9/00 190/10
5,165,534 A * 11/1992 Kaufman ..... A45C 11/34 206/214
6,402,142 B1 6/2002 Warren et al.
6,925,739 B1 * 8/2005 Cole ..... G09D 3/04 206/45.2
8,146,747 B2 * 4/2012 Luciano, Jr. ..... G06F 19/3462 206/534
8,235,825 B2 * 8/2012 French ..... G07F 17/32 463/47
2003/0230012 A1 * 12/2003 Mouyal ..... G09F 1/06 40/124.08
2006/0151586 A1 * 7/2006 Kao ..... B65D 5/3657 229/186
2011/0121062 A1 * 5/2011 Hui ..... B65D 5/241 229/247
2014/0042697 A1 2/2014 Berube et al.
2014/0138908 A1 5/2014 Grauzer et al.
2015/0157926 A1 6/2015 Shigeta

OTHER PUBLICATIONS

10XBETA, DEALN Kickstarter (online), Nov. 9, 2016 (retrieved on Mar. 6, 2018), Retrieved from <https://vimeo.com/190871343>.

* cited by examiner

SECTION B–B

PLAYING-CARD CASE

CROSS REFERENCE TO RELATED APPLICATIONS

The present is the U.S. National Phase Application of PCT Application No. PCT/US2017/062015, filed Nov. 16, 2017, which in turn relates and claims priority to U.S. provisional patent application No. 62/422,865, filed on Nov. 16, 2016, the entire content of each of which is incorporated herein by reference.

BACKGROUND

The present invention relates generally to a case for playing cards, and more particularly to a foldable case suitable for dealing playing cards. Playing cards are used in many gambling games and other recreational games. In most card games, the cards are dealt to the players at the outset of the game. The deck of cards is often stacked with the cards arranged in a random order before they are dealt to the players. In many card games, the cards are dealt with the face of the card facing downward toward the playing surface so that the markings on the card are not visible to the players.

Conventional playing-card cases and card dealing machines are expensive and cumbersome. Transporting such bulky cases and machines can be difficult and discourages use. Further, many bulky playing-card devices are difficult to load and require burdensome maneuvering to deal the cards. Therefore, there exists a need for a playing-card case that is pocket-sized and suitable for loading, dealing and transporting cards.

SUMMARY

The present invention is a playing-card case, and more specifically, a foldable playing-card case for dealing cards. The case includes a first portion having a base with a slit and a pair of opposing sidewalls extending perpendicular from the base. The base of the first portion is hingedly connected to an angled wall of a second portion of the case. The angled wall is connected to a base of the second portion, which also has a pair of opposing sidewalls extending perpendicular thereto. A third portion of the case has a base with a pair of opposing sidewalls extending perpendicular thereto. The base of the third portion is hingedly connected to the base of the second portion. The base of the third portion is also connected to an angled wall.

The case has two pairs of magnets, a first pair of magnets on the opposing sidewalls of the first portion and a second pair of magnets on the opposing sidewalls of the third portion. The first pair of magnets aligns with and connects to the second pair of magnets when the base of the first portion and the base of the second portion are rotated toward the angled wall of the third portion. The first portion rotates about a first hinged connection and the second portion rotates about a second hinged connection such that the case achieves a parallelogram shape when the base of the first portion meets the angled wall of the third portion.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
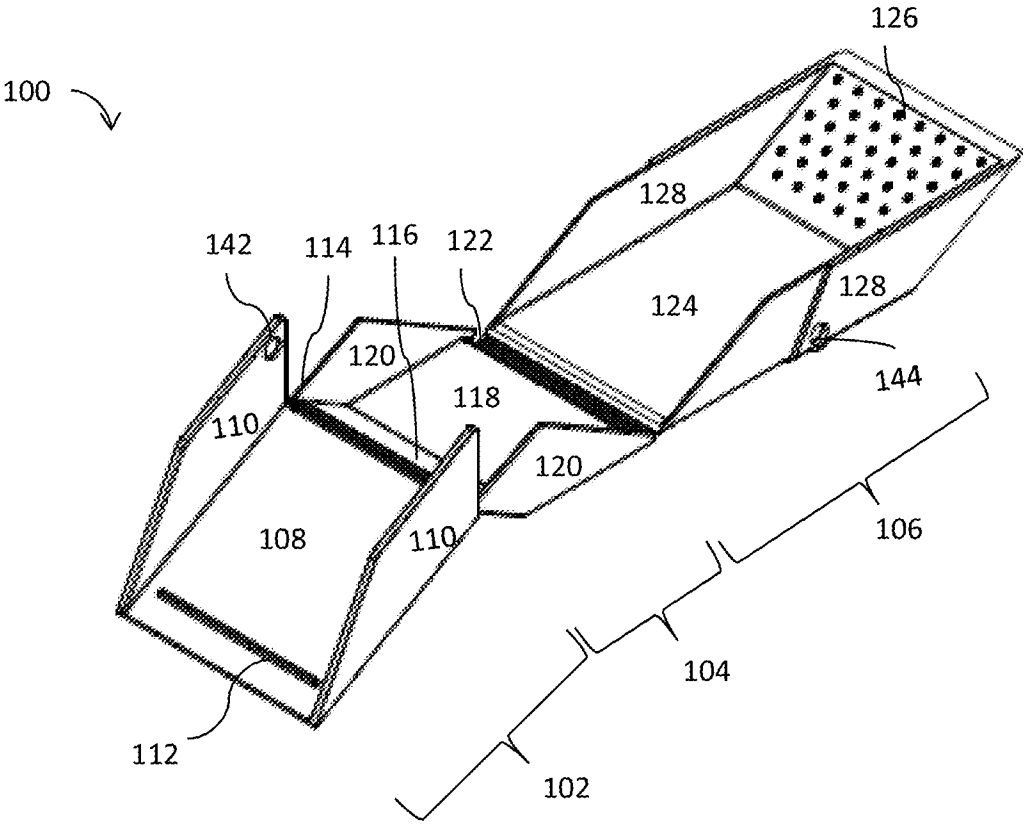
FIG. 1 is a perspective view of a non-limiting illustrative embodiment of the playing-card case in the unfolded position.
Figure 2A:
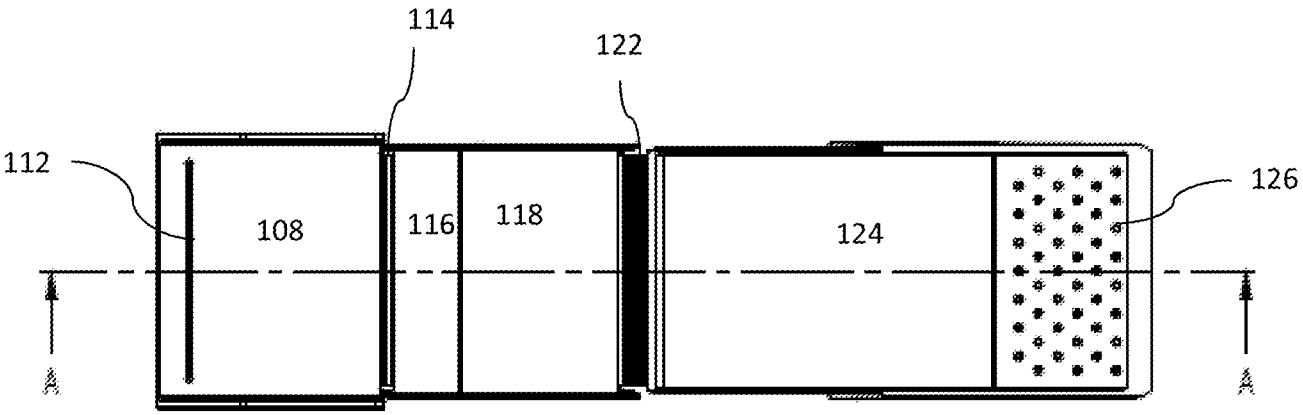
FIG. 2A is a top view of a non-limiting illustrative embodiment of the playing-card case in the unfolded position.
Figure 2B:
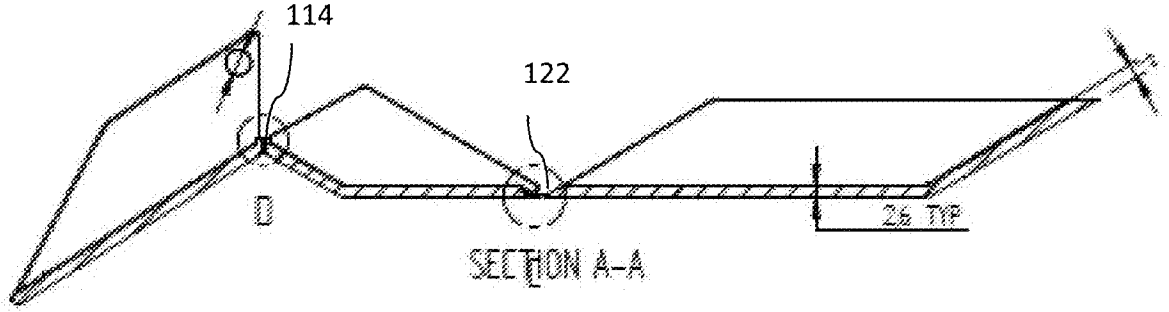
FIG. 2B is a cross-sectional view of a non-limiting illustrative embodiment of the playing-card case along line A-A of FIG. 2A.
Figure 3A:
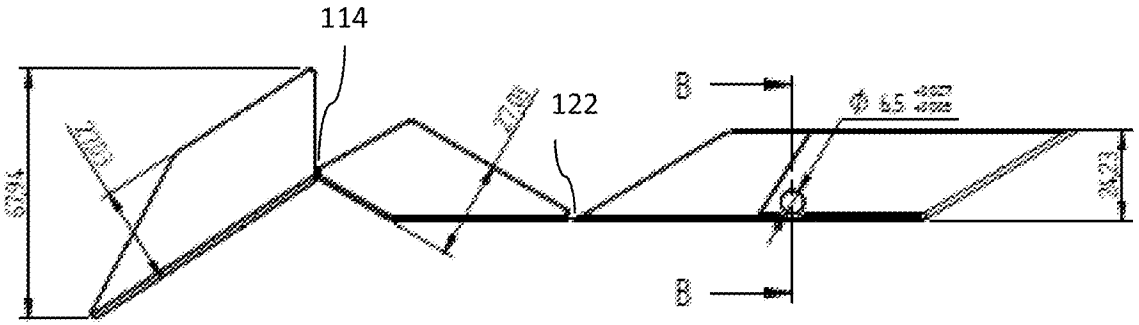
FIG. 3A is a side view of a non-limiting illustrative embodiment of the playing-card case in the unfolded position.
Figure 3B:
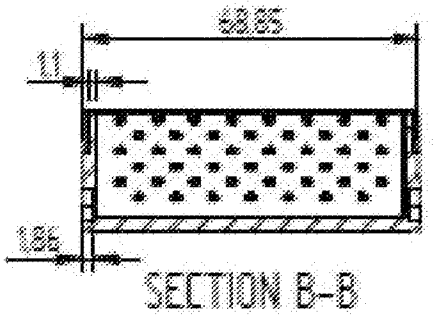
FIG. 3B is a cross-sectional view of non-limiting illustrative embodiment of the playing-card case along line B-B of FIG. 3A.

Referring to the Figures, the present invention is a foldable playing-card case. FIG. 1 shows a perspective view of a non-limiting illustrative embodiment of the playing-card case in the unfolded position. The card case 100 comprises a first portion 102 hingedly connected to a second portion 104, which is hingedly connected to a third portion 106. The first portion 102 comprises a base 108 with a pair of opposing sidewalls 110 extending perpendicular to the base 108.

The base 108 of the first portion 102 further comprises a slot 112 extending across and through the base 108. In the depicted embodiment, the slot 112 extends across the base 108 of the first portion 102 at an end opposing a first hinged connection 114. Also in the depicted embodiment, the slot 112 extends across the base 108 between the opposing sidewalls 110, but does not extend completely to each of the opposing sidewalls 110. In use, the playing-card case deals or otherwise distributes cards from the case via the slot 112. Therefore, the slot 112 is sized to accommodate the passing of conventional playing cards therethrough.

The first portion 102 of the case 100 is connected to the second portion 104 via the first hinged connection 114. The second portion 104 of the case 100 comprises a first angled wall 116 connected to a base 118. The base 118 has a pair of opposing sidewalls 120 extending perpendicular from the base 118. The first angled wall 116 is connected to the base 108 of the first portion 102 via the first hinged connection 114. In the depicted embodiment, the opposing sidewalls 110 of the first portion 102 are spaced farther apart than the opposing sidewalls 120 of the second portion and the base 108 of the first portion 102 is slightly wider than the base 118 of the second portion 104. When the first portion 102 is rotated about the first hinged connection 114, the opposing sidewalls 110 of the first portion 102 overlap the opposing sidewalls 120 of the second portion 104. Overlapping of the opposing sidewalls 110, 120 aids in creating an inner volume of the case 100.

The second portion 104 of the case 100 is connected to the third portion 106 of the case at a second hinged connection 122. The base 118 of the second portion is connected to a base 124 of the third portion 106 via the second hinged connection 122. The base 124 of the third portion 106 comprises a second angled wall 126 connected to a pair of opposing sidewalls 128 extending perpendicularly from the base 124. In the depicted embodiment, when the second portion 104 is rotated about the second hinged connection 122, the opposing sidewalls 120 of the second portion 104 overlap the opposing sidewalls 128 of the third portion 106. Overlapping of the opposing sidewalls 120, 128 further aids in creating an inner volume of the case 100. In the depicted embodiment, the opposing sidewalls 120 of the second portion 104 are spaced farther apart than the opposing sidewalls 128 of the third portion 106 and the base 118 of the second portion 104 is slightly wider than the base 124 of the third portion 106 to accommodate overlapping.

Thus, when the first portion 102 is folded via the first hinged connection 114 and the second portion 104 is folded via the second hinged connection 122, the base 108 of the first portion 102 meets the second angled wall 126 of the third portion 106 and the case 100 is in the folded position. The case 100 maintains the folded position configuration with two pairs of magnets. A first pair of magnets 142 is on the opposing sidewalls 110 of the first portion 102, one magnet on each sidewall. A second pair of magnets 144 is on the opposing sidewalls 128 of the third portion 106, one magnet on each sidewall. In the depicted embodiment, the first pair of magnets 142 is on an interior of the opposing sidewalls 110 of the first portion 102, while the second pair of magnets 144 is on an exterior of the opposing sidewalls 128 of the third portion 106. However, the reverse configuration is also contemplated. The first pair of magnets 142 and the second pair of magnets 144 are positioned such that they align when the case 100 is in the folded position.

Referring now to FIGS. 2A-3B, there are shown top, side and cross-sectional views of non-limiting illustrative embodiments of the playing-card case in the unfolded position. In the depicted embodiments, the opposing sidewalls 110 of the first portion 102 have a parallelogram section 130 and a triangular section 132. However, the opposing sidewalls 128 of the third portion 106 comprise only a parallelogram section 134. In the depicted embodiment, the parallelogram section 134 of the third portion 106 is elongated and greater in length than the parallelogram section 130 of the first portion 102. The opposing sidewalls 120 of the second portion 104 comprise a first edge 136 and a second edge 138 converging to form a vertex 140. In the depicted embodiment, the vertex 140 is directly above the base 118 of the second portion 104, although it is contemplated that the vertex 140 may also extend above the first angled wall 116 or above where the first angled wall 116 and the base 118 converge. The angular configurations of each portion 102, 104, 106 provide the framework for creating a parallelogram-shaped case 100 when the case 100 is in the folded position.

Figure 4:
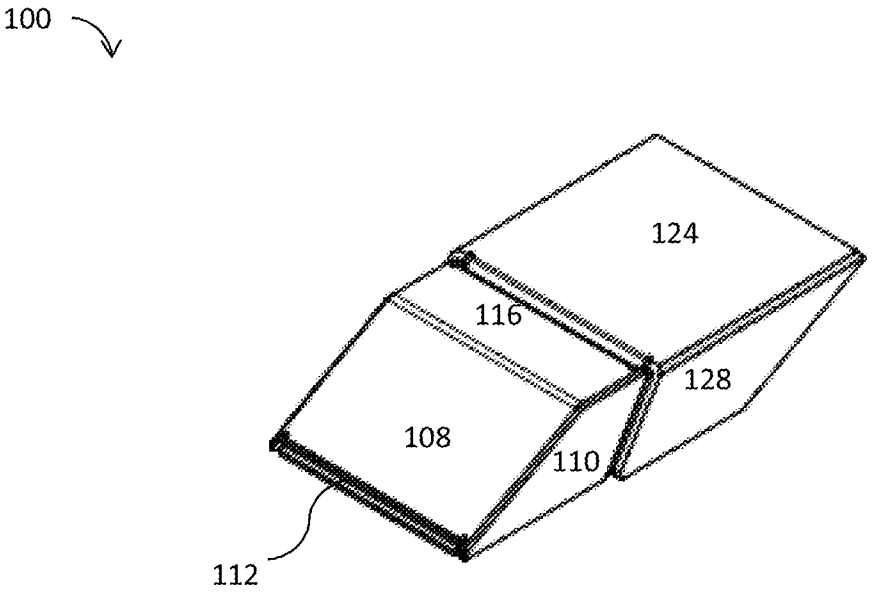
FIG. 4 is a perspective view of a non-limiting illustrative embodiment of the playing-card case in the folded position.
Figure 5:
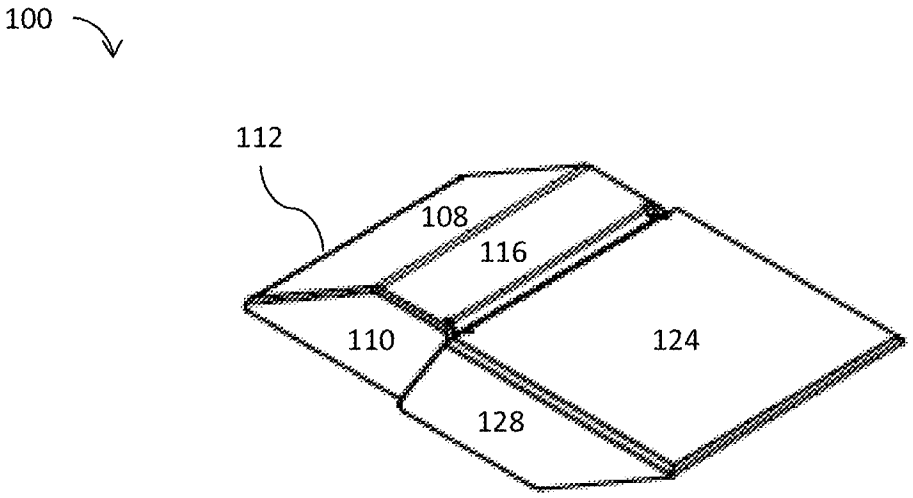
FIG. 5 is an alternative perspective view of a non-limiting illustrative embodiment of the playing-card case in the folded position.
Figure 6A:
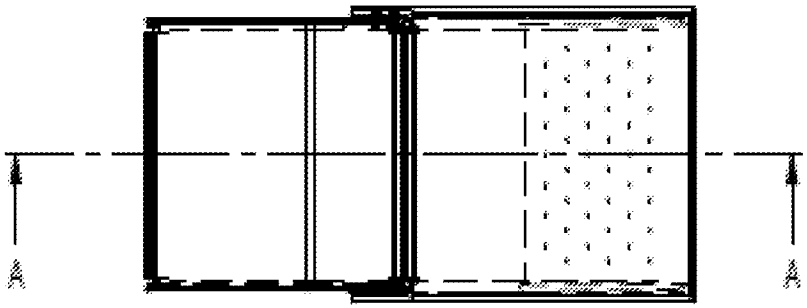
FIG. 6A is a top view of a non-limiting illustrative embodiment of the playing-card case in the folded position.
Figure 6B:
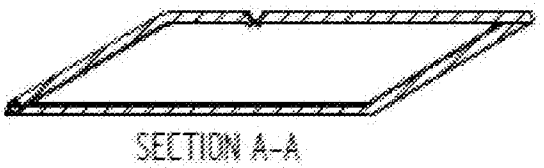
FIG. 6B is a cross-sectional view of a non-limiting illustrative embodiment of the playing-card case along line A-A of FIG. 6A.
Figure 7A:
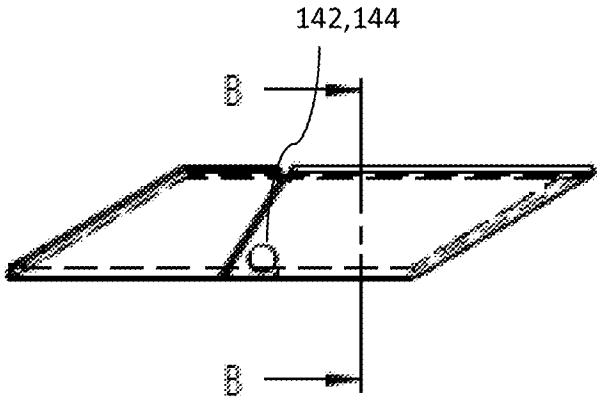
FIG. 7A is a side view of a non-limiting illustrative embodiment of the playing-card case in the folded position.
Figure 7B:
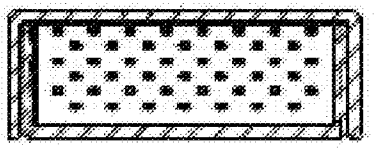
FIG. 7B is a cross-sectional view of a non-limiting illustrative embodiment of the playing-card case along line B-B of FIG. 7A.
Figure 8:
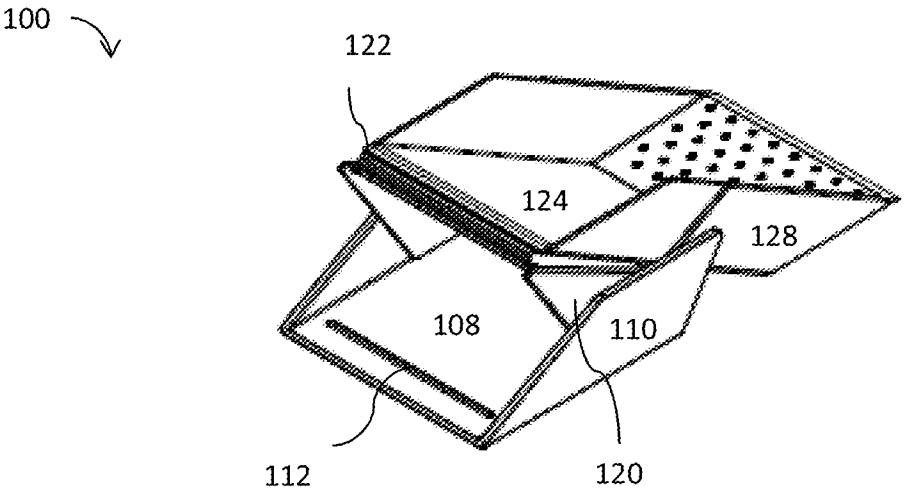
FIG. 8 is a perspective view of a non-limiting illustrative embodiment of the playing-card case in the loading position.
Figure 9:
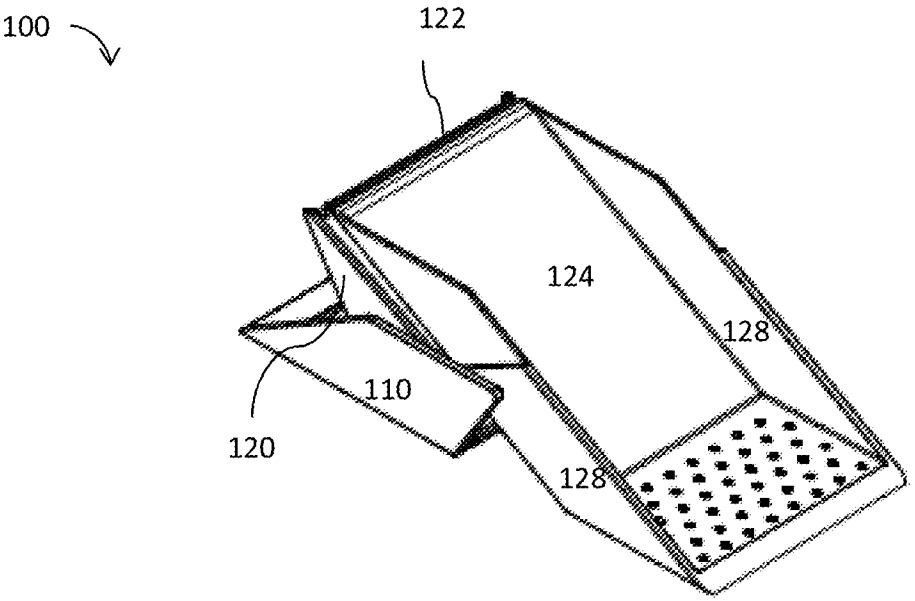
FIG. 9 is an alternative perspective view of a non-limiting illustrative embodiment of the playing-card case in the loading position.
Figure 10A:
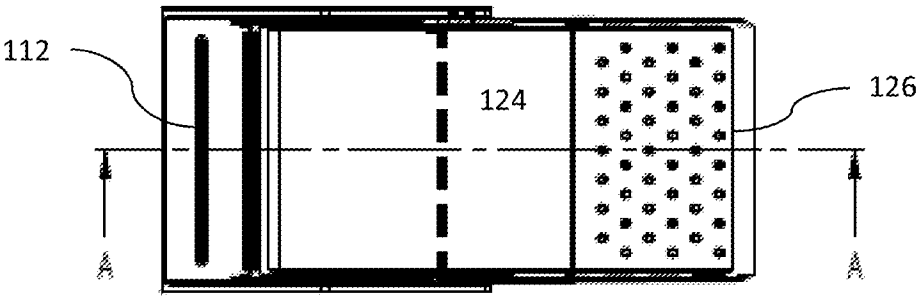
FIG. 10A is a top view of a non-limiting illustrative embodiment of the playing-card case in the loading position.
Figure 10B:
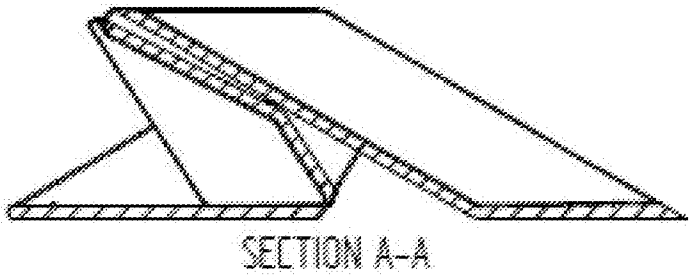
FIG. 10B is a cross-sectional view of non-limiting illustrative embodiments of the playing-card case along line A-A of FIG. 10A.
Figure 11:
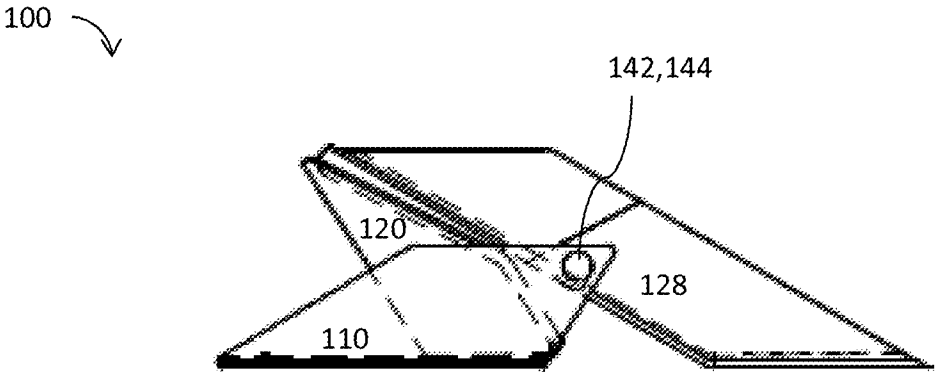
FIG. 11 is a side view of a non-limiting illustrative embodiment of the playing-card case in the loading position.
Figure 12:
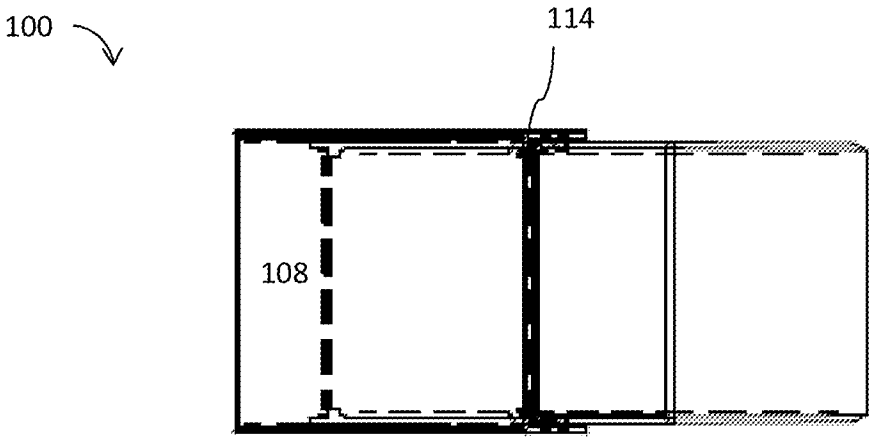
FIG. 12 is a top view of a non-limiting illustrative embodiment of the playing-card case in the loading position.
Figure 13:
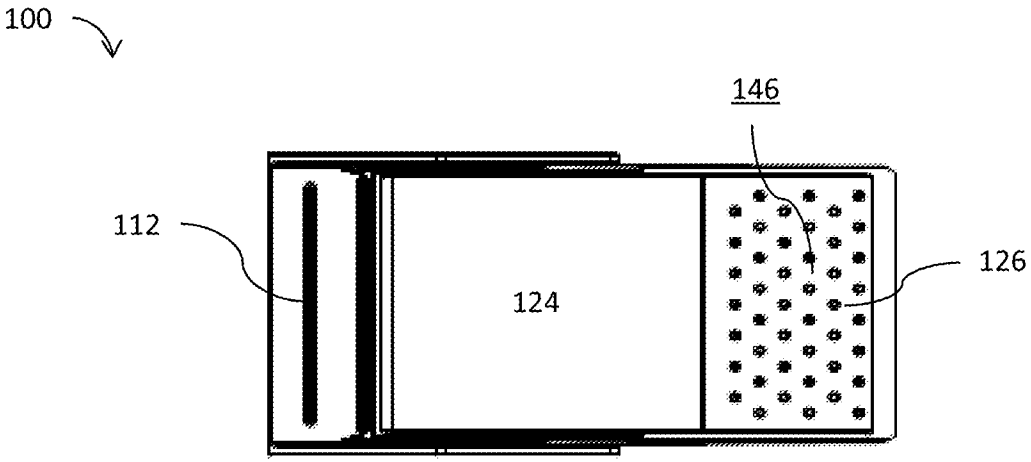
FIG. 13 is an additional top view of a non-limiting illustrative embodiment of the playing-card case in the loading position.

Referring now to FIGS. 4 and 5, there are shown perspective views of non-limiting illustrative embodiments of the playing-card case in the folded position. As shown in the depicted embodiments, the case 100 comprises a parallelogram shape in the folded position. FIGS. 6A-7B show top, side and cross-sectional views of non-limiting illustrative embodiments of the playing-card case in the folded position. As shown in FIG. 7A, the first pair of magnets 142 and the second pair of magnets 144 are aligned and connected when the case 100 is in the folded position. The connection between the magnets 142, 144 maintains the parallelogram shape of the case 100 so that playing cards can be stored within the case 100 and dealt through the slot 112.

Referring now to FIGS. 9-13, there are shown various views of the case in a loading position. In FIGS. 9-10A and 13, the case 100 is shown to additionally comprise an uneven surface 146 on the second angled wall 126. The uneven surface 146 aids in maintaining the cards in a stacked orientation when loading the case 100. Thus, playing cards can be loaded into the case 100 by placing the cards in a stacked orientation with the first card placed against the base 124 of the third portion 106. As the cards are stacked on top of each other, the uneven surface 146 on the second angled wall 126 prevents the cards from sliding out of the case 100. The uneven surface 146 can be formed by ridges, protrusions, and projections, for example, in the second angled wall 126. From the loaded position, the case 100 can be extended to the unfolded position, as shown in FIG. 1, where the first portion 102 and second portion 104 can be rotated until the folded position, as shown in FIGS. 4-5, is reached. Once the folded position is reached, both pairs of magnets 142, 144 maintain the case 100 in the folded position so the cards can be dealt from the slot 112. The case 100 may be comprised of polypropylene material and/or any other like material.

While embodiments of the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed:

1. A card case, comprising:

a first portion having a base with a slit therethrough and a pair of opposing sidewalls extending perpendicular from the base;

a second portion having an angled wall connected to a base, the base having a pair of opposing sidewalls extending perpendicular from the base;

wherein the angled wall of the second portion is hingedly connected to the base of the first portion;

a third portion having a base with a pair of opposing sidewalls extending perpendicular thereto, the base connected to an angled wall;

wherein the base of the third portion is hingedly connected to the base of the second portion;

a first pair of magnets, one magnet on each of the opposing sidewalls of the first portion; and a second pair of magnets, one magnet of each of the opposing sidewalls of the third portion;

wherein the first pair of magnets connect to the second pair of magnets when the base of the first portion is rotated toward the angled wall of the third portion.

2. The card case according to claim 1, wherein the pair of opposing sidewalls of said first base are spaced greater apart than are the said pair of opposing sidewalls of said second portion.

3. The card case according to claim 1, wherein said angled wall of said third portion comprises an uneven surface.

4. The card case according to claim 1, wherein the slit extends across the base between the pair of opposing sidewalls of the first portion.

5. The card case according to claim 1, wherein the angled wall connected to the base of the third portion has an uneven surface.

6. The card case according to claim 1, wherein in a first position, the base of the second portion and the base of the first portion are planar.

7. The card case according to claim 6, wherein in the first position, the base of the first portion extends at an angle relative to the base of the second portion and the angled wall connected to the base of the third portion extends at an angle relative to the base of the third portion.

8. The card case according to claim 6, wherein in a second position, the angled wall of the second portion and the base of the third portion are parallel.

9. The card case according to claim 8, wherein in a third position, the base of the first portion and the angled wall connected to the base of the third portion are planar.

10. The card case according to claim 9, wherein in the second position and the third position, the first pair of magnets are connected to the second pair of magnets.

11. The card case according to claim 7, wherein the base of the first portion is parallel to the angled wall connected to the base of the third portion.

12. A card case, comprising:

a first portion having a base with a card passage opening formed therethrough and a pair of opposing sidewalls extending from the base;

a second portion having a wall connected to a base, the base having a pair of opposing sidewalls extending from the base;

wherein the wall of the second portion is movably connected to the base of the first portion;

a third portion having a base with a pair of opposing sidewalls extending therefrom, the base connected to a wall; and wherein the base of the third portion is movably connected to the base of the second portion.

13. The card case according to claim 12, further comprising:

a. a first pair of magnets, one magnet on each of the opposing sidewalls of the first portion; and b. a second pair of magnets, one magnet of each of the opposing sidewalls of the third portion;

wherein the first pair of magnets connect to the second pair of magnets when the base of the first portion is rotated toward the angled wall of the third portion.

14. The card case according to claim 13, wherein in a first position, the wall of the second portion extends at an angle from the base of the first portion and the wall of the third portion extends at an angle from the base of the third portion.

15. The card case according to claim 14, wherein in a second position, the wall of the second portion and the base of the third portion are parallel.

16. The card case according to claim 15, wherein in a third position, the base of the first portion and the wall connected to the base of the third portion are planar.

17. The card case according to claim 16, wherein in the second position and the third position, the first pair of magnets are connected to the second pair of magnets.

18. The card case according to claim 14, wherein in the first position, the first pair of magnets are disconnected from the second pair of magnets.

19. The card case according to claim 12, wherein said card passage opening comprises an elongated slit formed through said base of said first portion.

20. The card case according to claim 12, wherein the wall connected to the base of the third portion has an uneven surface.

* * * * *